US006024389A

United States Patent [19]

Arabia, Jr. et al.

[11] Patent Number: 6,024,389

[45] Date of Patent: Feb. 15, 2000

[54] VEHICLE DOOR LATCH WITH STIFFNESS ADJUSTMENT

[75] Inventors: Frank Joseph Arabia, Jr., Macomb Township, Macomb County; Donald Michael Perkins, Rochester Hills; Jeffrey Joseph Boucke, Davisburg, all of Mich.

[73] Assignee: General Motors Corporation, Detroit, Mich.

[21] Appl. No.: 09/144,816

[22] Filed: Aug. 31, 1998

[51] Int. Cl.[7] ..... E05C 3/06

[52] U.S. Cl. ..... 292/216; 292/341.18; 292/DIG. 23; 292/DIG. 60; 292/DIG. 73

[58] Field of Search ..... 292/216, 341.12, 292/341.18, DIG. 23, DIG. 38, DIG. 51, DIG. 55, DIG. 56, DIG. 60, DIG. 73; 70/461

[56] References Cited

U.S. PATENT DOCUMENTS

| | | | |
|---|---|---|---|
| 1,847,937 | 3/1932 | Fetters | 411/60.2 |
| 4,474,515 | 10/1984 | Pitzer | 411/16 |
| 4,756,563 | 7/1988 | Garwood et al. | 292/216 |
| 4,941,696 | 7/1990 | Yamada et al. | 292/340 |
| 5,071,178 | 12/1991 | Brackman et al. | 292/216 |
| 5,106,134 | 4/1992 | Thau | 292/216 |
| 5,141,270 | 8/1992 | Shibata | 292/216 |
| 5,328,219 | 7/1994 | Konchan et al. | 292/216 |
| 5,727,825 | 3/1998 | Spurr | 292/341.12 |

*Primary Examiner*—Darnell M. Boucher
*Assistant Examiner*—Clifford B Vaterlaus
*Attorney, Agent, or Firm*—Kathryn A. Marra

[57] ABSTRACT

A vehicle door latch has a latching mechanism and stiffness adjustment mechanism disposed in a housing. The housing includes a fishmouth slot for receiving a striker. The latching mechanism includes a fork bolt that moves between a latching position and an unlatching position. The fork bolt has a throat that is aligned with the throat of the housing for receiving the striker when the fork bolt is in the unlatching position and that captures the striker when the fork bolt is in the latching position. An overslam bumper has an elastomeric portion located at a rearward end of the housing slot. The elastomeric portion engages the striker and biases the striker against a surface of the throat of the fork bolt when the striker is captured. The elastomeric portion is preloaded by the stiffness adjustment mechanism that includes a flexible portion of the housing, an expandable bushing, a nut that slides in the bushing for expanding the bushing and an adjustment screw that screws into the nut. The nut is readily accessible at a surface of the vehicle door for adjusting the stiffness of the door latch.

13 Claims, 3 Drawing Sheets

VEHICLE DOOR LATCH WITH STIFFNESS ADJUSTMENT

TECHNICAL FIELD

This invention relates generally to a vehicle door latch and more particularly to a vehicle door latch that has a rotatable fork bolt that captures a jamb-mounted striker in a housing throat when the vehicle door is slammed shut.

BACKGROUND OF THE INVENTION

U.S. Pat. No. 4,756,563 granted to Stephen K. Garwood and Jeffrey L. Konchan on Jul. 12, 1988 for a vehicle door latch, which is hereby incorporated in this patent specification by reference, discloses a known vehicle door latch comprising a plastic housing and a metal face plate that define a "fishmouth" slot that receives a jamb-mounted striker when the vehicle door is closed. The door latch also includes a fork bolt that is rotatably mounted in the housing on a pivot pin so as to swing in the housing between an unlatched position and a latched position where the fork bolt captures the striker in the fishmouth slot of the housing. A releasable detent holds the fork bolt in the latched position.

The housing includes an elastomeric bumper or cushion at the back or inboard end of the fishmouth slot that is engaged by the striker when the vehicle door is slammed shut to absorb energy and reduce noise during the door closure operation. The captured striker compresses the elastomeric bumper so that the striker biases the fork bolt against the detent.

U.S. Pat. No. 5,328,219 granted to Jeffrey L. Konchan, Alfred L. Portelli and Rita M. Paulik on Jul. 12, 1994 for a vehicle door latch shows another known vehicle door latch that also includes an elastomeric bumper or cushion at the back of the door latch slot to absorb energy and reduce noise during the door closure operation and to bias the fork bolt against the detent.

The composition of the elastomeric bumper and the amount of compression by the captured striker determine the stiffness of the vehicle door latch. Known vehicle door latches such as those discussed above have a relatively constant stiffness.

The stiffness of a vehicle door latch can affect vehicle ride quality directly along with vibrations in the steering column, floor pan and vehicle seats. Smaller cars are usually less concerned about these effects and more concerned about door closing and door opening efforts. On the other hand, larger cars are usually more concerned about ride quality which is affected by poor latch stiffness more easily than are smaller cars. Thus, the relatively constant stiffness of known vehicle door latches exemplified by the patents discussed above must be changed to tailor the vehicle door latch to each specific vehicle. The stiffness of known vehicle door latches such as those discussed above can be changed for each specific vehicle by using different elastomeric bumpers made of materials having different durometers. However, this solution proliferates the number of vehicle door latch designs, adds inventory and manufacturing costs and introduces the possibility of installing the wrong elastomeric bumper.

SUMMARY OF THE INVENTION

The object of this invention is to provide a vehicle door latch that has a mechanism for adjusting the stiffness of the door latch so that the door latch can be tailored to a variety of vehicle models without any need for changing the elastomeric bumper or any other component of the vehicle door latch.

A feature of the vehicle door latch of the invention is that the stiffness of the vehicle door latch can be tailored to a particular vehicle easily.

Another feature of the vehicle door latch of the invention is that the stiffness of the vehicle door latch can be tailored after the vehicle door latch has been installed.

Still another feature of the vehicle door latch of the invention is that the stiffness of the vehicle door latch can be adjusted without any need for removing parts.

Yet another feature of the vehicle door latch of the invention is that the stiffness of the vehicle door latch can be adjusted without any need for special tools.

Still yet another feature of the vehicle door latch of the invention is that the vehicle door latch has a n accessible adjustment screw so that the stiffness of the vehicle door latch can be adjusted easily.

Still yet another feature of the vehicle door latch of the invention is that the vehicle door latch is equipped with a stiffness adjustment mechanism that is compact and fits within the confines of known designs.

These and other objects, features and advantages of the invention will become apparent from the description below, which is given by way of example with reference to the accompanying drawings.

DESCRIPTION OF THE PREFERRED EMBODIMENT

Figure 1:
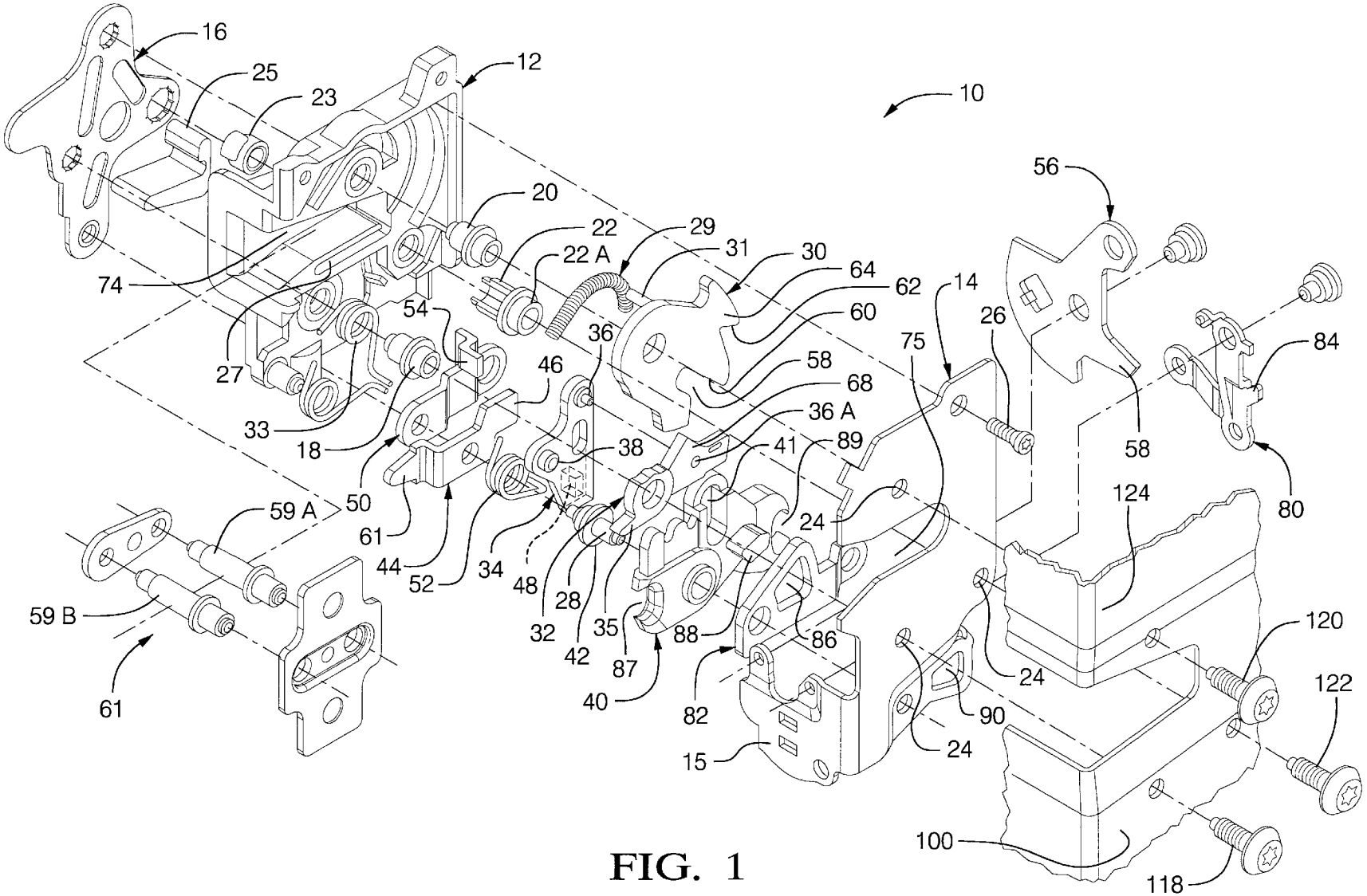
FIG. 1 is an exploded perspective front view of a vehicle door latch in accordance with the invention.

Referring now to FIG. 1, the vehicle door latch 10 has a multi-piece enclosure that comprises plastic housing 12, metal face plate 14 and metal back plate 16. The plastic housing 12 and the metal back plate 16 are held together by three flanged bushings 18, 20 and 22 that are inserted into three holes in the plastic housing 12, then through three aligned holes in the back plate 16 and then flanged over the back plate.

Bushings 18 and 20 are threaded internally. Bushing 22 is part of a stiffness adjustment mechanism that cooperates with nut 23 to adjust the stiffness of an elastomeric bumper 25 that fits into a slot 27 in plastic housing 12 as explained in detail below.

The metal face plate 14 has three bolt holes 24 that are aligned with the bushings 18, 20 and 22 when the metal face plate is attached to the plastic housing 12 by a screw 26. The metal face plate 14 and the metal back plate 16 have lower portions below the plastic housing 12 that are held together by a flanged stud 28 that has projecting pins at each end that are inserted in holes in the plates and peened or headed over.

The Latch Mechanism

The latch mechanism of the vehicle door latch 10 comprises a fork bolt 30 and a cooperating detent 32 that are pivotally mounted on bushings 20 and 18 respectively and located in a chamber of the plastic housing 12 behind the metal face plate 14. The fork bolt 30 is biased clockwise by a coil spring 29. Coil spring 29 is disposed in a curved slot in the plastic housing 12 behind the fork bolt 30, and it engages a depending pin 31 of the fork bolt 30 at one end. Detent 32 is biased counterclockwise into engagement with the fork bolt 30 by a coil spring 33 that surrounds bushing 18 and that has one end engaging an ear 35 of detent 32. Detent 32 engages and holds fork bolt 30 at shoulder 60 in a primary latched position against the bias of spring 29 as shown in FIG. 1. Detent 32 also can engage fork bolt 30 at shoulder 62 and hold it in an intermediate secondary latched position. Detent 32 engages fork bolt 30 at foot 64 in its unlatched position.

The latching mechanism further comprises an intermittent lever 34 for operating detent 32. Intermittent lever 34 is located in the chamber of the plastic housing 12 behind detent 32. It has two integral pivot pins 36 and 38. Pivot pin 36 is journalled in a hole 32*a* in detent 32 so that the detent 32 rotates counterclockwise from the latched position shown in FIG. 1 and out of latched engagement with the fork bolt 30 to the unlatched position (not shown) when intermittent lever 34 is pulled down. Pivot pin 38 is disposed in a slot 41 of a locking lever 40 that pivots the intermittent lever 34 counterclockwise about pivot pin 36 from the unlock position shown in FIG. 1 to a lock position (not shown). Locking lever 40 is journalled on stud 28 between a flange 42 and face plate 14. Briefly, locking lever 40 is rotated clockwise to lock the door latch 10 or counterclockwise to unlock the door latch. Clockwise rotation pivots intermittent lever 34 counterclockwise about pivot pin 36 to a lock position where it is uncoupled from and out of the path of travel of unlatching lever 44 as described below. A more complete description of the locking lever 40 and lock mechanism is given after the operation of the latching mechanism is described.

The latch mechanism further comprises unlatching lever 44 that is journalled on a reduced diameter portion of the stud 28 spaced rearwardly of the flange 42. Unlatching lever 44 has an ear 46 at one end that is engageable with an integral, rearwardly projecting tab 48 of the intermittent lever 34 so that the intermittent lever 34 is pulled down when the transfer lever 44 is rotated clockwise as viewed in FIG. 1.

The latch mechanism further comprises an outside handle lever 50 and a coil return spring 52. Handle lever 50 is also journalled on the reduced diameter portion of the stud 28 behind the unlatching lever 44. It has a bent tab 54 that engages ear 46 of the unlatching lever 44 so that the outside handle lever 50 rotates unlatching lever 44 clockwise when it is rotated clockwise on stud 28. Outside handle lever 50 is connected by suitable linkage for rotation by an outside door handle (not shown).

The coil return spring 52 is disposed around stud 28 and located between flange 42 and unlatching lever 44. One end of coil spring 52 engages the bottom of unlatching lever 44 and the other end engages the bottom of plastic housing 12 above unlatching lever 44 so that unlatching lever 44 and outside handle lever 50 are biased counterclockwise to a rest position where tab 54 engages the bottom of the plastic housing 12.

The latch mechanism further comprises an inside handle lever 56 that is pivotally mounted on a flange 15 of metal face plate 14. Inside handle lever 56 has a tab 58 that engages a second ear 61 of unlatching lever 44 so that inside handle lever 56 also rotates unlatching lever 44 clockwise when it is rotated counterclockwise. Inside handle lever 56 is connected by suitable linkage for rotation by an inside door handle or other operator (not shown).

Housing 12 and face plate 14 have aligned fishmouth slots 74 and 75 that receive strike pins 59*a* and 59*b* forming part of a conventional strike assembly 61 that is attached to the vehicle door pillar when the vehicle door is closed (not shown). Fork bolt 30 has a conventional slot or throat 58 for receiving and retaining strike pin 59*a* to latch the vehicle door in the closed position. Fork bolt 30 also includes a primary latch shoulder 60, an intermediate secondary latch shoulder 62 and a radially projecting foot 64. Fork bolt 30 preferably has a plastic coating that covers a surface of the slot 58 that is engaged by the striker for energy absorption and quiet operation when the vehicle door is slammed shut.

Detent 32 has a sector-shaped catch 68 that engages the radially projecting foot 64 when the fork bolt 30 is in the unlatched position (not shown). The sector-shaped catch 68 positively engages the primary and secondary latch shoulders 60 and 62 to hold the fork bolt 30 in either the primary latched position shown in FIG. 1 or the intermediate secondary latched positions (not shown). Detent 32 also preferably includes a plastic coating that has an integral bumper. The bumper engages portion 22*a* (FIG. 3) of bushing 22 to stop counterclockwise pivoting of the detent lever 32 under the bias of spring 33. This bumper also absorbs energy and quiets operation when the door is slammed shut.

The Stiffness Adjustment Mechanism

Figure 2:
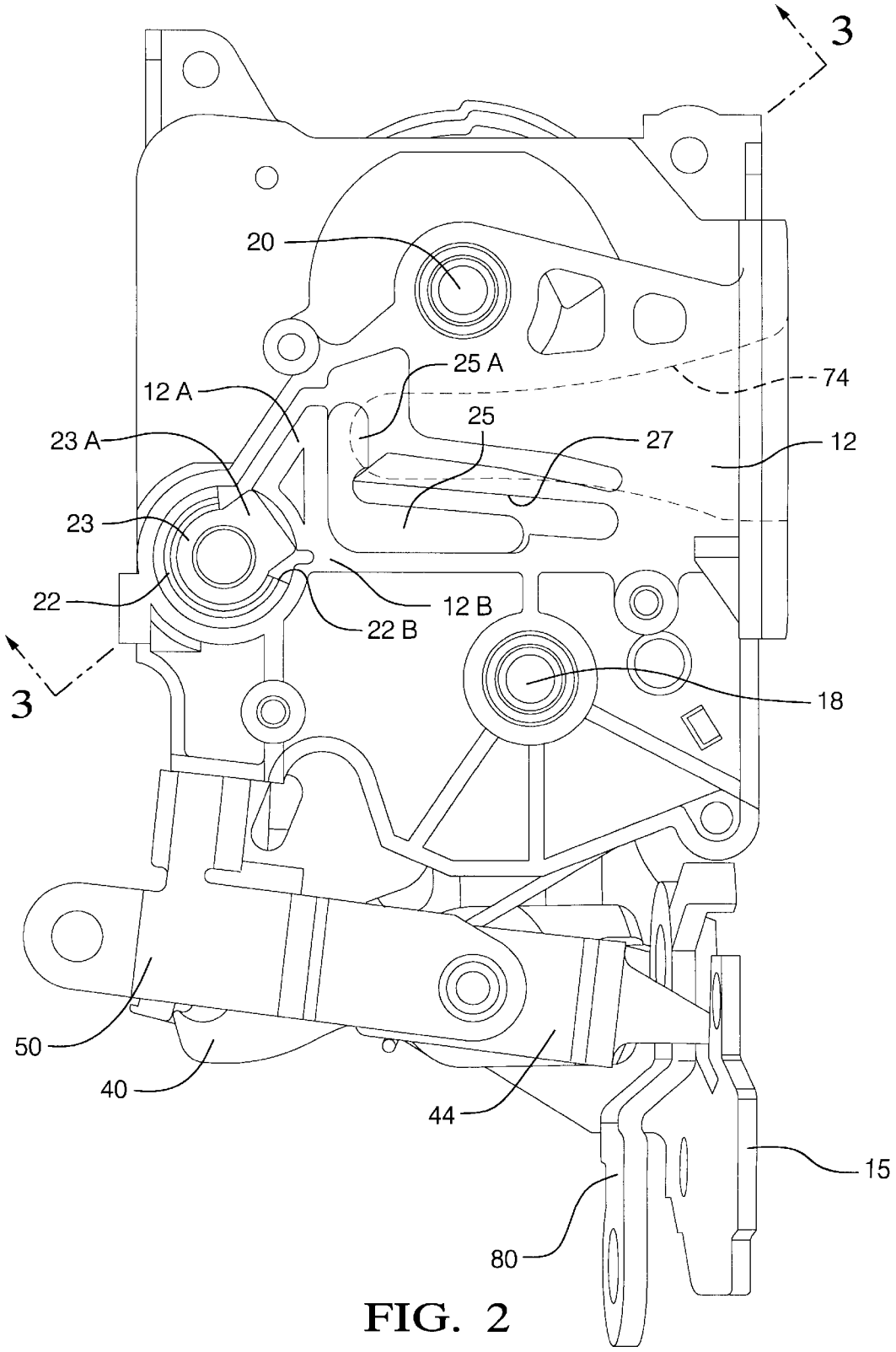
FIG. 2 is an enlarged fragmentary rear view of the vehicle door latch shown in FIG. 1 with the back plate removed.
Figure 3:
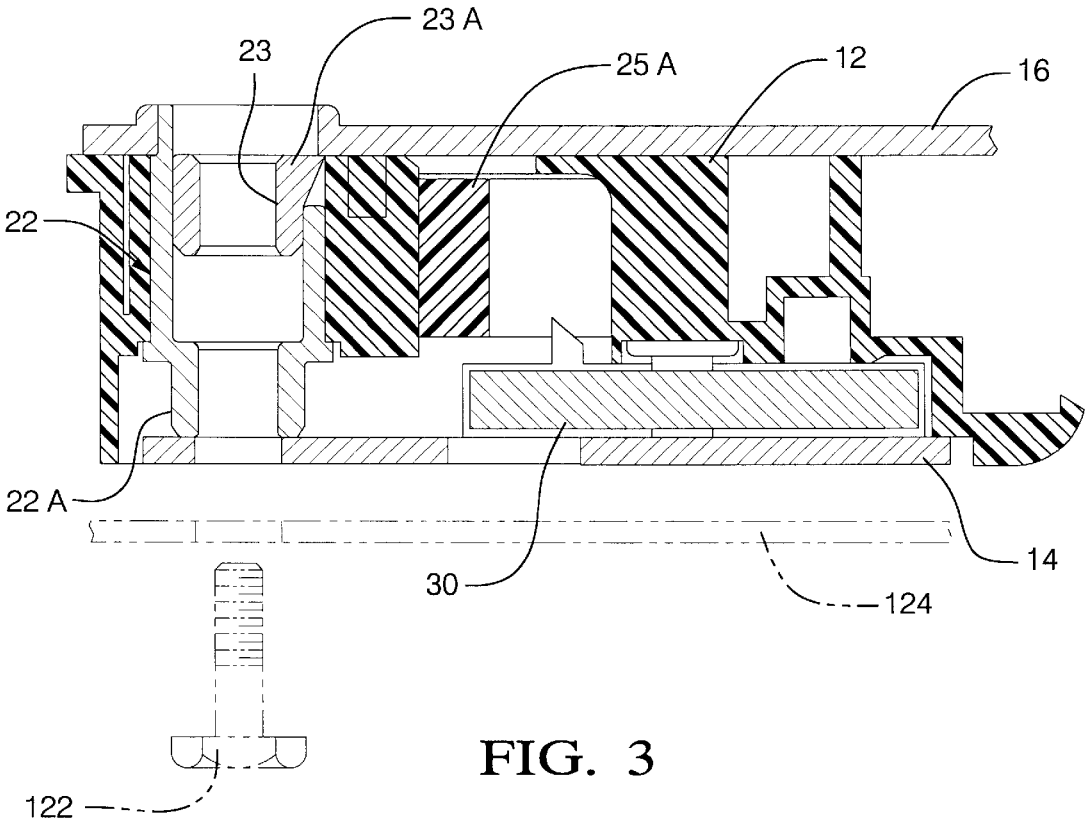
FIG. 3 is a sectional view taken substantially along the line 3—3 of FIG. 2 looking in the direction of the arrows.
Figure 4:
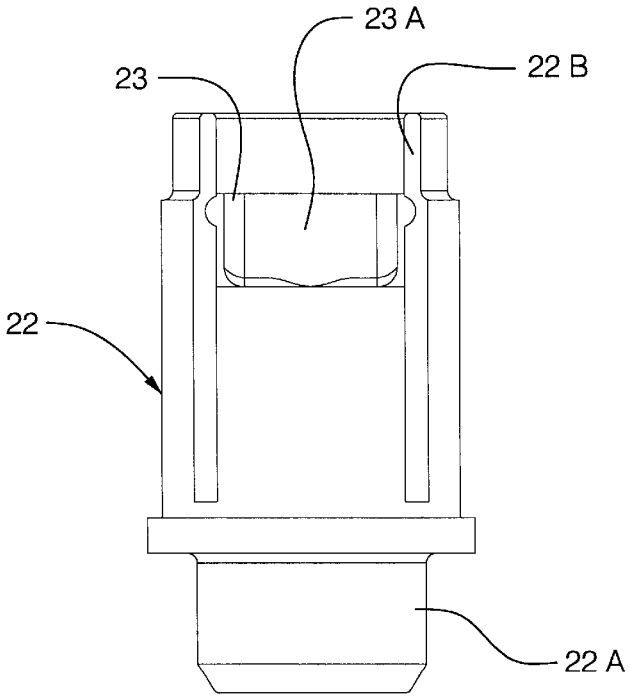
FIG. 4 is a side view of the adjustable stiffness bushing and nut shown in FIG. 3.

As indicated above, bushing 22 and nut 23 are part of a stiffness adjustment mechanism for elastomeric bumper 25. The elastomeric bumper 25 is L-shaped and fits into slot 27 so that the vertical leg 25*a* is at the back or inboard end of fishmouth slot 74 as best shown in FIGS. 2 and 3. Bumper 25 nearly extends across the width of slot 74 with one end near back plate 16 and the opposite end near fork bolt 30 as best shown in FIG. 3. As indicated above, the stiffness of the elastomeric bumper 25 in general and the vertical leg 25*a* in particular is adjusted by the stiffness adjustment mechanism. To this end, vertical leg 25*a* rests against a flexible interior vertical wall 12*a* of housing 12 that defines part of the hole for bushing 22. Wall 12*a* is substantially detached from the rest of housing 12 except for a web-like portion 12*b* connecting the bottom of wall 12*a* to housing 12 near slot 27.

Bushing 22 also has a reduced forward end 22*a* that projects out of the hole and that serves as a stop for the bumper of detent 32 shown in FIG. 1 as stated above. Bushing 22 also has a slot 22*b* at the rearward end that is aligned with the flexible interior vertical wall 12*a* of housing 12. Nut 23 slides in the bore of the enlarged rearward portion of bushing 22, and it has a wedge-shaped projection 23*a* that is disposed in slot 22*b*.

Door latch 10 is mounted in the interior of a vehicle door 100 by three machine screws 118, 120 and 122 that project through holes in door panel 124 and screw into the bushings 18, 20 and 22, respectively. After the door latch is mounted by the three machine screws, the stiffness of bushing 22 is adjusted by turning machine screw 122 to draw nut 23 forwardly into bushing 22. This pushes the wall of bushing 22 outward deflecting flexible housing wall 12*a* against vertical leg 25*a* of elastomeric bumper 25. This increases the spring constant of elastomeric bumper 25 and the stiffness of vehicle door latch 10. The stiffness of door latch 10 is decreased or softened by turning machine screw 122 to push nut 23 rearwardly, causing the wall of bushing 22 and flexible housing wall 12*a* to retract and reduce the load on the vertical leg 25*a* of elastomeric bumper 25. In this manner, the stiffness of door latch 10 can be tailored to the particular vehicle in which door latch 10 is installed. Moreover, the adjustment is made easily after installation due to the accessibility of machine screw 122 which acts as an adjustment screw that can be turned by an ordinary screw driver. It should also be noted the stiffness adjustment mechanism is compact and fits within housing 12 without any need for enlarging housing 12.

Operation of the Latch Mechanism

The latch mechanism described above operates as follows. When the door latch 10 is in an unlatched and unlocked condition, fork bolt 30 is poised to receive strike pin 59*a* that projects into aligned fish mouth slots 73 and 75 of the plastic housing 12 and the metal face plate 14 when the door is slammed shut. The entering strike pin 59*a* engages the back of the throat 58 and rotates fork bolt 30 counterclockwise against the bias of spring 29 until strike pin 59*a* hits leg 25*a* of elastomeric bumper 25 and fork bolt 30 is rotated to the primary latch position shown in FIG. 1 where fork bolt 30 captures strike pin 59*a* in throat 58. Fork bolt 30 is held in the primary latch position by catch 68 of detent 32 engaging the primary latch shoulder 60 of fork bolt 30. When captured, strike pin 59*a* is biased against the surface of throat 58 by bumper leg 25*a*. Bumper leg 25*a* provides the stiffness characteristic for the door latch 10. This stiffness characteristic is adjustable as stated above.

Catch 68 rides a long the periphery of the fork bolt 30 under the bias of spring 33 as fork bolt 30 rotates counterclockwise from the unlatched position to the primary latch position shown in FIG. 1. During this travel, catch 68 rides under the foot 64 into engagement with the intermediate secondary latch shoulder 62 and then into engagement with the primary latch shoulder 60. Engagement of catch 68 with the intermediate secondary latching shoulder 62 is sufficient to hold the vehicle door closed in the event that the vehicle door is not shut with sufficient force so that catch 68 engages primary latch shoulder 60.

The vehicle door latch 10 is now latched but not locked so that the vehicle door can be opened simply by operating either an inside or outside door handle or the like to rotate the unlatching lever 44 clockwise moving the ear 46 down as viewed in FIG. 1. Ear 46 engages projection 48 of intermittent lever 34 and pulls the intermittent lever 34 down from the primary latch position. As the intermittent lever 34 is pulled down, it rotates detent 32 clockwise against the bias of spring 33 from the primary latch position shown in FIG. 1. Fork bolt 30 is then free to rotate clockwise under the bias of spring 29 from the primary latch position shown in FIG. 1 to the unlatched position as the striker pin 59*a* is pulled out of the aligned fishmouth slots 73 and 75 when the vehicle door is opened.

The Lock Mechanism

The lock mechanism of door latch 10 is actuated by rotating the locking lever 40 that is journalled on stud 28 between flange 42 and face plate 14 clockwise. Clockwise rotation of the locking lever 40 rotates intermittent lever 34 counterclockwise about pivot pin 36 that is journalled in the detent 32 due to the engagement of pivot pin 38 of intermittent lever 34 in slot 41 of locking lever 40. Intermittent lever 34 is thus rotated counterclockwise from the unlocked position shown in FIG. 1 to a locked position where projection 48 is repositioned out from under ear 46 of unlocking lever 44. Consequently, when the door handles or the like are operated so as to rotate the unlatching lever 44 clockwise to the unlatching position, ear 46 simply bypasses projection 48 without transferring any motion to intermittent lever 34. Consequently, intermittent lever 34 is not pulled down to rotate detent 32 to the unlatch position. In other words, unlatching lever 44 simply freewheels so that operation of the door handles or their equivalent is not effective.

The lock mechanism further comprises an inside locking lever 80 and an outside lock lever 82. Inside locking lever 80 is pivotally mounted on flange 15 of metal face plate 14 at a location spaced from the pivot for inside handle lever 56. Inside locking lever 80 has an ear 84 that fits in a slot 87 at one end of locking lever 40. Outside locking lever 82 is pivotally mounted on stud 28 in front of locking lever 40. Locking lever 40 has a protuberance 88 that projects through a sector-shaped hole 86 in outside locking lever 82 and then through a smaller sector-shaped hole 90 in face plate 14.

Protuberance 88 and sector-shaped hole 90 limit rotation of locking lever 40 from an unlocked position shown in FIG. 1 where protuberance 88 engages the upper edge of hole 90 to a locked position (not shown) where protuberance 88 engages the lower edge of hole 90.

Locking lever 40 is rotated clockwise from the unlocked position shown in FIG. 1 to the locked position by rotating inside locking lever 80 counterclockwise as viewed in FIG. 1. Inside locking lever 80 is actuated by a suitable linkage system (not shown) for rotation by an inside sill button or other operator (not shown).

Locking lever 40 can also be rotated clockwise from the unlocked position shown in FIG. 1 to the locked position by rotating outside locking lever 82 clockwise so that slot 86 drives protuberance 88. Outside locking lever 82 is generally actuated by a key lock cylinder through a suitable linkage (not shown). Outside locking lever 82 is an optional member that may be omitted in rear door applications that do not have a lock cylinder. Locking lever 40 also has a slot 89 at the opposite end for operating locking lever 40 by power, for instance by a linear electric or vacuum motor.

The Unlocking and Unlatching Operation

When locked vehicle door latch 10 is locked and latched, door latch 10 is unlocked and then unlatched by two distinct operators. First, unlocking lever 40 is rotated counterclockwise to the unlocked position shown in FIG. 1 either by a key lock cylinder (not shown) acting via outside locking lever 82, an inside sill button or the like (not shown) acting via inside locking lever 80 or a motor (not shown). This rotation moves tab 48 of intermittent lever 34 beneath ear 46 of unlatching lever 44. Door latch 10 is then unlatched by rotating unlatching lever 44 clockwise by a second distinct operator such as an outside door handle (not shown) acting via outside handle lever 50 or an inside door handle (not shown) acting via inside handle lever 56. This rotation pulls intermittent lever 34 down and releases detent 32 from lock bolt 30.

Many modifications and variations of the present invention in light of the above teachings may be made. It is, therefore, to be understood that, within the scope of the appended claims, the invention may be practiced otherwise than as specifically described.

We claim:

1. A vehicle door latch having a latching mechanism and a stiffness adjustment mechanism comprising:

a housing for the latching mechanism and the adjustable stiffness mechanism, the housing including a slot for receiving a striker, the latching mechanism including a fork bolt in the housing that moves between a latching position and an unlatching position, the fork bolt having a throat that is aligned with the slot of the housing for receiving the striker when the fork bolt in the unlatching position and that captures the striker when the fork bolt is in the latching position, the stiffness adjustment mechanism having a bumper in the housing that has an elastomeric portion located at a rearward end of the slot of the housing so as to engage the striker and bias the striker against a surface of the throat of the fork bolt when the striker is captured by the fork bolt, and the stiffness adjustment mechanism having means for adjusting the stiffness of the elastomeric portion of the bumper that engages and biases the striker against the surface of the throat of the fork bolt when the striker is captured by the fork bolt.

2. The vehicle door latch according to claim 1 wherein the stiffness adjustment mechanism includes a flexible portion of the housing that engages the elastomeric portion of the bumper to adjust the spring rate of the elastomeric portion.

3. The vehicle door latch according to claim 2 wherein the stiffness adjustment mechanism includes a bushing that has an expandable wall.

4. The vehicle door latch according to claim 3 wherein the stiffness adjustment mechanism includes a nut that slides in the bushing for expanding the expandable wall of the bushing.

5. The vehicle door latch according to claim 4 wherein the nut has a wedge shaped portion that engages the expandable wall of the bushing.

6. The vehicle door latch according to claim 5 wherein the stiffness adjustment mechanism includes an adjustment screw that screws into the nut.

7. The vehicle door latch according to claim 6 wherein the adjustment screw mounts the vehicle door latch in a vehicle door and is readily accessible at a surface of the vehicle door for adjusting the stiffness of the door latch.

8. A vehicle door latch having a latching mechanism and a stiffness adjustment mechanism comprising:

a housing for the latching mechanism and the adjustable stiffness mechanism, the housing including a slot for receiving a striker, the latching mechanism including a fork bolt in the housing that moves between a latching position and an unlatching position, the fork bolt having a throat that is aligned with the slot of the housing for receiving the striker when the fork bolt in the unlatching position and that captures the striker when the fork bolt is in the latching position, the stiffness adjustment mechanism having an elastomeric bumper in the housing that has an elastomeric portion located at a rearward end of the slot of the housing so as to engage the striker and bias the striker against a surface of the throat of the fork bolt when the striker is captured by the fork bolt, and the stiffness adjustment mechanism including a bushing that has an expandable wall, a nut that slides in the bushing for expanding the expandable wall of the bushing, and an adjustment screw for positioning the nut in the bushing for adjusting the stiffness of the elastomeric portion of the bumper that biases the striker against the surface of the throat of the fork bolt when the striker is captured by the fork bolt.

9. The vehicle door latch according to claim 8 wherein the nut has a wedge-shaped portion that engages the expandable wall of the bushing.

10. The vehicle door latch according to claim 8 wherein the adjustment screw mounts the vehicle door latch in a vehicle door and is readily accessible at a surface of the vehicle door for adjusting the stiffness of the door latch.

11. The vehicle door latch according to claim 8 wherein the stiffness adjustment mechanism includes a flexible portion of the housing that engages the elastomeric portion of the bumper to adjust the spring rate of the elastomeric portion.

12. A vehicle door latch having a latching mechanism and a stiffness adjustment mechanism comprising:

a housing for the latching mechanism and the adjustable stiffness mechanism, the housing including a fishmouth slot for receiving a striker and a second slot that communicates with an inboard end of the fishmouth slot, the latching mechanism including a fork bolt in the housing that moves between a latching position and an unlatching position, the fork bolt having a throat that is aligned with the fishmouth slot of the housing for receiving the striker when the fork bolt in the unlatching position and that captures the striker when the fork bolt is in the latching position, the adjustable stiffness adjustment mechanism having an elastomeric bumper disposed in the second slot of the housing so that an elastomeric portion of the bumper is located at the inboard end of the fishmouth slot of the housing so as to engage the striker and bias the striker against a surface of the throat of the fork bolt when the striker is captured by the fork bolt, the housing having a flexible wall that engages the flexible portion of the elastomeric bumper and that partly defines a hole in the housing, a bushing disposed in the hole that is partly defined by the flexible wall of the housing, the bushing having an expandable wall that engages the flexible wall of the housing, a nut that slides in the bushing and that has a wedge-shaped portion for expanding the expandable wall of the bushing, and an adjustment screw for positioning the nut in the bushing for adjusting the stiffness of the elastomeric portion of the bumper that biases the striker against the surface of the throat of the fork bolt when the striker is captured by the fork bolt.

13. The vehicle door latch according to claim 12 wherein the adjustment screw mounts the vehicle door latch in a vehicle door and is readily accessible at a surface of the vehicle door for adjusting the stiffness of the door latch.

* * * * *